United States Patent [19]

Held

[11] Patent Number: 4,598,564

[45] Date of Patent: Jul. 8, 1986

[54] METHOD OF PROFILING METAL STRIPS

[76] Inventor: Kurt Held, Alte Strasse 1, 7218 Trossingen 2, Fed. Rep. of Germany

[21] Appl. No.: 634,174

[22] Filed: Jul. 24, 1984

Related U.S. Application Data

[63] Continuation of Ser. No. 521,638, Aug. 10, 1983, abandoned, which is a continuation of Ser. No. 263,565, May 14, 1981, abandoned.

[30] Foreign Application Priority Data

May 16, 1980 [DE] Fed. Rep. of Germany ..... 3018759

[51] Int. Cl.[4] ..... B21B 5/00

[52] U.S. Cl. ..... 72/111; 72/197

[58] Field of Search ..... 72/191, 197, 198, 111; 226/52, 76; 101/24, 23; 264/284; 83/309, 371; 219/68, 121 LY, 121 EX, 121 EY

[56] References Cited

U.S. PATENT DOCUMENTS

| | | | |
|---|---|---|---|
| 1,966,006 | 7/1934 | Fischer et al. | 226/52 |
| 3,250,102 | 5/1966 | Howeler | 72/197 |
| 3,305,422 | 2/1967 | Hamilton | 101/24 |
| 3,559,568 | 2/1971 | Stanley | 226/28 |
| 3,686,917 | 8/1972 | Hikida et al. | 72/180 |
| 4,115,683 | 9/1978 | Clark et al. | 219/121 LY |
| 4,233,833 | 11/1980 | Balinski | 72/180 |

*Primary Examiner*—Lowell A. Larson

*Attorney, Agent, or Firm*—Toren, McGeady, Stanger, Goldberg & Kiel

[57] ABSTRACT

In profiling the surface of a metal strip, particularly pressed strips for use in double band presses, the pressed strip is provided with graduations on a surface outside of the surface to be profiled. The graduations on the strip correspond to graduations on a tool used to profile the strip surface. With the graduations on both strip and tool in register, synchronized movements of the strip and the tool is effected with the strip being rolled into surface contact with the profiling surface of the tool so that the profiling surface of the tool is reproduced on the strip.

3 Claims, 1 Drawing Figure

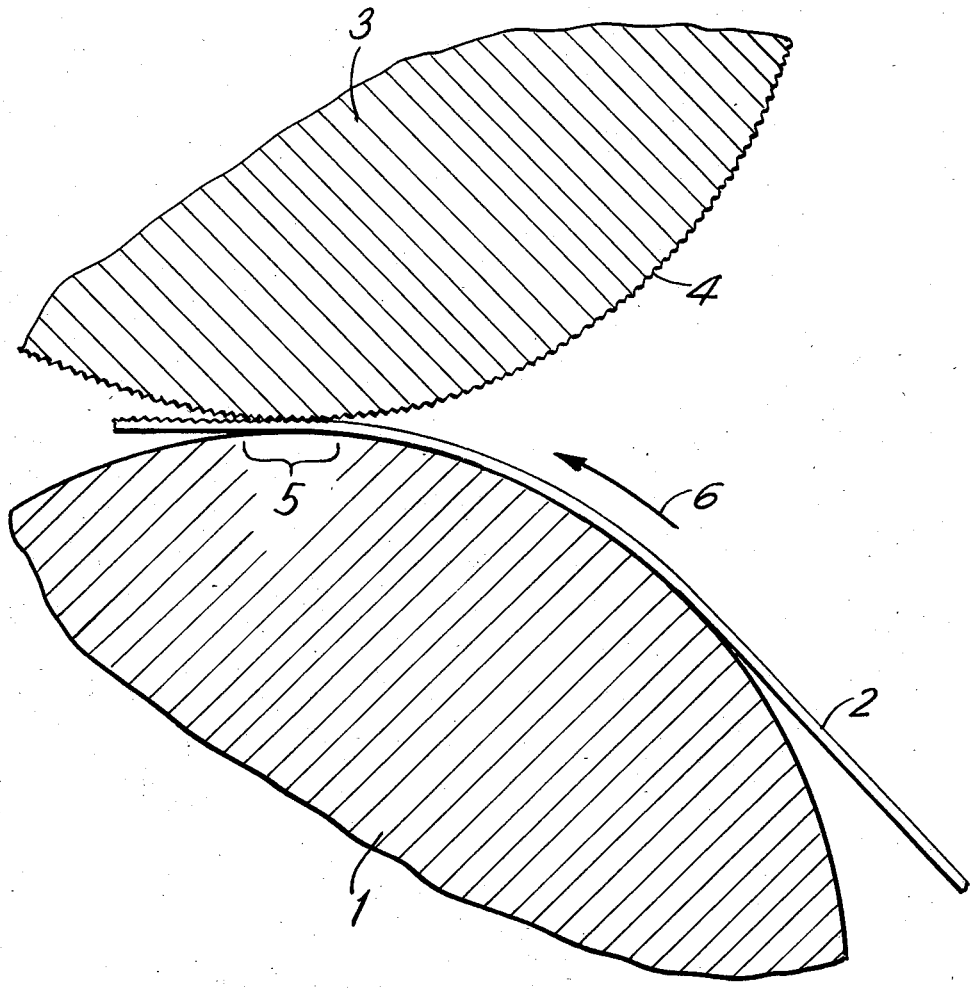
3
4
5
6
2
1

METHOD OF PROFILING METAL STRIPS

This application is a continuation of Ser. No. 521,638, filed Aug. 10, 1983, which was a continuation of application Ser. No. 263,565, filed May 14, 1981, both now abandoned.

SUMMARY OF THE INVENTION

The present invention is directed to a method of profiling a surface of metal strips, in particular, pressed strips for double band presses.

Profiling workpiece surfaces, such as pressed strip surfaces, can be effected by stamping, removing or sloughing-off material of the workpiece for profiling its surface. Where the surface of the workpiece is sloughed-off the procedure is commonly referred to as the so-called cutting or chip-removing process. Such a metal working process includes chipping, planing, hammering, sawing, turning, milling, grinding, drilling and the like.

Further, it is known to carry out the sloughing-off or removal of the material by electrothermal means, by spark erosion, or by electrochemical means. The electrothermal removal is performed in a stationary discharge process using an electric arc where the removal procedure is of a purely thermal nature. In spark or electroerosion, the removal is effected by spark erosion, however, the discharging process is not stationary, rather it is controlled through special energy sources which supply the spark gap with pulse-like bursts of energy. Furthermore, the electrodes can perform mechanical oscillation and rotational movements to assist in the removal work. By introducing a dielectric working fluid between the electrodes, the distance between them can be significantly reduced and the sloughing-off effect of the discharge can be substantially increased. Material removal by electrochemical means, otherwise referred to as electrochemical immersion, is carried out by inserting a cathode pole processing tool or a tool electrode with a constant feed speed into an anode pole workpiece or a workpiece electrode. A working slot is established between the workpiece and the tool as a result of this process with an electrolyte solution flowing at high speed through the slot for carrying off the removed material and also for removing the heat generated by the flow of current. Finally, profiling of the surface can be achieved by stamping rolls or grooved rolls. The grooved roll processing is performed by pressing the profiled surface of a grooved roll against the surface to be profiled.

There are a number of methods and devices for the electro-erosion or electrochemical processing of workpieces and also for processing workpieces using a stamping procedure with the workpieces being of a number of different kinds. To-date, however, these various processes have not been used on metal strips or pressed strips, since there has been a technical prejudice against using these well known processes for profiling metal strips and, in particular, pressed strips. Furthermore, there has been difficulty in adapting the geometrically indefinite form of the outer surface of the pressed strip and its dimensions to the processing tools so that a satisfactory surface texture without projections could be produced. With regard to the state of the art reference is made to German Pat. Nos. 1 298 854; 1 440 999; 1 565 468 and 1 961 676; British Pat. Nos. 856 340 and 885 793; French Pat. No. 1 224 109 and U.S. Pat. Nos. 3,042,789 and 3,363,082.

It is also known to shape or profile the outer surface of rolls for use in printing or stamping workpiece surfaces by the above-mentioned methods. In carrying out such a procedure, the circumference of the tool (or of the electrode employed in an electrothermal or electrochemical process) and the circumference of the roll to be profiled are dimensioned so that the pattern length can be accommodated by a whole number of times on the surface of the roll to be profiled.

Therefore, the primary object of the present invention is to adapt the known state of the art used in pressing and stamping rolls in the profiling of pressed strips for double band presses with the strips having a length as distinguished from the rolls, which is several times the usual roll circumference and the length is such that it can be determined only at considerable expense. To further complicate matters, the length must be maintained or any change in length must be constantly measured and adjusted during the processing operation.

In accordance with the present invention, the surface of the pressed strip outside the surface to be profiled, is provided with graduations arranged to register with corresponding graduations on the profiling tool or the graduations can be checked by electronic or mechanical means to provide a synchronization of the movement of the tool and the workpiece or strip for reproducing the surface profile of the tool on the strip through electrothermal, electrochemical or mechanical processing. The graduations on the strip surface correspond to a whole number multiple of the graduations on the profiling tool. The length of the graduations on the tool may be its full circumferential length or it may be a lesser dimension if the reference length on the tool is not for its full circumference.

A forced synchronization between the outer surface of a driven guide drum supporting the pressed strip can be achieved, for example, by a gear-toothed system as disclosed in the German Offenlegungsschrift No. 2 737 629. In this patent publication gear teeth extend along the side edges of steel strips and mesh with gear teeth on a corresponding hollow gear wheel on the guide drum.

With this synchronization it can be assured that during the rolling of the strip an exact whole number of lengths equal to the toothed tool circumference can be formed on the pressed strip surface so that the beginning and end of the profiled surface merge into one another without any visible projections taking into account the possible presence of slippage.

In carrying out this procedure, the pressed strip is stretched over two guide drums and driven by means of gear teeth on the edge. The tool or tool electrode engages or meshes at an appropriate location with the pressed strip stretched over the guide drums and is driven in a rolling manner. If both drive mechanisms are synchronized either mechanically by a known gear arrangement or electrically by well known position control systems, then the projection-free surface profiling of the pressed strip for double band presses is effective with a surface reproduction on the strip of the profiling surface on the tool down to the finest detail.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing a schematic partial sectional view is provided of apparatus for carrying out the present invention.

DETAIL DESCRIPTION OF THE INVENTION

In the drawing a strip 2, the surface of which is to be profiled, is stretched over a drum 1 driven in the direction of the arrow 6. A tool or tool electrode 3 having a profiling surface 4 to be reproduced on the strip 2 is positioned relative to the drum 1 so that it can effect a rolling action similar to the drum with contact between the profiling surface 4 and the surface of the strip 2 occurring in a synchronization region 5 on both the strip 2 and the tool 3. The synchronization is achieved by providing graduations, not shown, on the strip outside of the surface to be profiled so that these graduations register with graduations on the tool or tool electrode so that synchronization of the movement of the tool and the strip can be achieved.

While specific embodiments of the invention have been shown and described in detail to illustrate the application of the inventive principles, it will be understood that the invention may be embodied otherwise without departing from such principles.

I claim:

1. A method of profiling a surface of an elongated press belt for double band presses, comprising using a roll shaped profiling tool having a profiling surface, providing spaced graduations on the profiling tool outside the profiling surface, selecting a press belt made of a metallic strip with the beginning and the end of the strip being welded together to form an endless belt having a length which is several times the circumferential dimension of the roll shaped profiling tool and is selected to form a complete press belt for use in a double band press, graduating a surface of the endless press belt outside the surface thereof to be profiled with the graduations spaced to correspond to the graduations of the profiling tool, the graduations on one surface of the press belt are made in such a manner that no protrusions are formed on the other side of the press belt, registering the graduation on the press belt with the graduation on the profiling tool, rolling the profiling tool in the rolling direction of the press belt and synchronizing the rolling of the press belt and of the profiling tool based on the registration of the graduations, reproducing the profiling surface of the profiling tool on the surface of the press belt to be profiled, forming the graduations on the press belt corresponding to a multiple whole number of the dimension of the graduations on the profiling tool so that the commencement and termination of the profiled surface of the press belt merge into one another without any visible projections.

2. Method, as set forth in claim 1, wherein synchronizing the rolling of the strip and the profiling tool by mechanical means.

3. Method, as set forth in claim 1, including using a mechanical profiling tool.

* * * * *